United States Patent [19]

Kilbane et al.

[11] Patent Number: 4,729,912

[45] Date of Patent: Mar. 8, 1988

[54] OXIDATION RESISTANT FERROUS BASE FOIL AND METHOD THEREFOR

[75] Inventors: Farrell M. Kilbane, Centerville; F. Curtiss Dunbar, West Chester, both of Ohio

[73] Assignee: Armco Inc., Middletown, Ohio

[21] Appl. No.: 48,011

[22] Filed: May 8, 1987

Related U.S. Application Data

[62] Division of Ser. No. 741,282, Jun. 4, 1985, Pat. No. 4,686,155.

[51] Int. Cl.[4] ..... C23C 2/12

[52] U.S. Cl. ..... 427/376.8; 427/431; 148/6.3

[58] Field of Search ..... 148/6.3; 427/431, 376.8, 427/320

[56] References Cited

U.S. PATENT DOCUMENTS 4,675,214 6/1987 Kolbane ..... 427/320

*Primary Examiner*—Sam Silverberg

*Attorney, Agent, or Firm*—Frost & Jacobs

[57] ABSTRACT

Aluminum coated ferritic base metal foil formed by cold reduction of hot dip aluminum coated ferritic steel strip containing from 10% to about 35% chromium, up to 3% aluminum, and up to 1% silicon, the foil having a ratio of aluminum coating thickness on both sides to base metal foil thickness of at least 1:10, with at least 4% by weight total aluminum. The method of production includes heating the foil in an oxidizing atmosphere within specified temperature and time limitations to provide a porous surface having a thin layer of aluminum oxide. The foil is adapted for fabrication into monolithic support structures for catalytic converters for internal combustion engine exhaust systems.

6 Claims, 7 Drawing Figures

NOTE: PHOTOMICROGRAPHS (500X) OF ALUMINUM-COATED STEEL HEAT TREATED AT 700°C
FIG. 1A 0 MINUTES
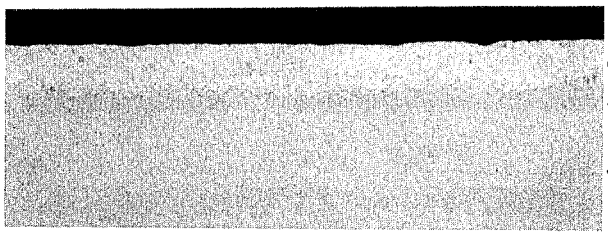
FIG. 1B 3 MINUTES
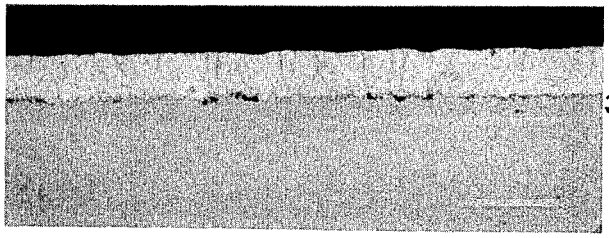
FIG. 1C 5 MINUTES
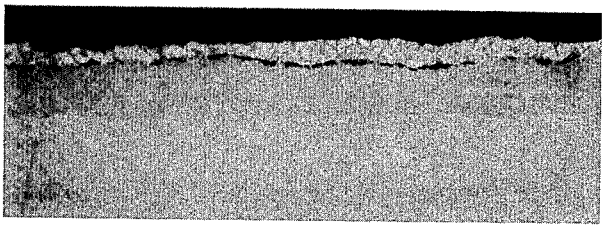
FIG. 1D 7 MINUTES
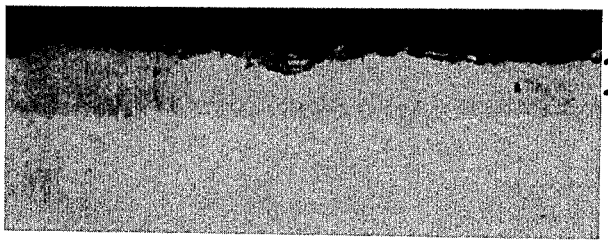

OXIDATION RESISTANT FERROUS BASE FOIL AND METHOD THEREFOR

This is a division of application Ser. No. 06/741,282, filed Jun. 4, 1985, now U.S. Pat. No. 4,686,155.

BACKGROUND OF THE INVENTION

This invention relates to an aluminum-coated ferrous-base foil having a thickness not greater than about 0.133 mm (0.005 in) exhibiting improved oxidation resistance at elevated temperature and improved corrosion resistance in moist atmospheres containing water vapor and combustion gases, and to a method for making such foil. Although not so limited, the invention has particular utility in fabricated monolithic support structures in catalytic converters for exhaust systems of internal combustion engines. The largest market for such catalytic converters is in automotive pollution control systems. The invention includes further method steps carried out after making the foil which provide the foil with advantageous properties as a catalyst support structure or substrate, in addition to the oxidation and wet corrosion resistance properties of the foil.

A support structure or substrate for automotive-type pollution control catalysts requires elevated temperature oxidation resistance because the catalytic converter temperature can reach 1100° C. (2000° F.) for short periods of time under extreme operating conditions. The typical operating temperature range is from about 540° to about 815° C. (1000° to 1500° F.). Most steels can withstand only a few hours at 815° C. in air or combustion gases before crumbling due to thermal oxidation. A catalyst support metal is required to maintain its structural integrity for at least 1000 hours at 815° C. in an oxidizing atmosphere.

A support structure for automotive-type pollution control catalysts must also have wet corrosion resistance. Wet corrosion conditions occur when the exhaust system cools and condensate accumulates in the porous surfaces in the converter. Rusting must be avoided, primarily because the iron-containing corrosion products can combine with the active catalyst metal and destroy catalytic activity. As is well known, the active catalyst metals presently used for automotive pollution control are usually from the platinum group, such as platinum, rhodium and/or palladium.

Support structures of the above type further require a surface which will bond strongly to a heat resistant catalyst support material (such as gamma aluminum oxide, alkaline earth metal oxides, scandium oxide, and/or yttrium oxide) which is applied to the substrate in order to provide a large surface area for the active catalyst metal. Large gas volumes can be treated by a relatively small catalytic converter by using the increased surface area provided by a porous coating such as gamma aluminum oxide (typically called a washcoat). Cyclic thermal gradients cause spalling of the washcoat if it is not securely bonded to the substrate.

A support structure for automotive-type pollution control catalyst frequently has a honeycomb shape, and thin cell walls are required for this configuration. If the metal support material is formed from a continuous strip, it should be capable of reduction by rolling to foil thickness in order to meet the requirement for a thin cell wall. The thin cell walls exhibit three advantages. First, back pressure is reduced because there is less cross-sectional area to impede gass flow. Second, the catalyst begins working sooner because the lower mass of metal heats up faster. Catalytic converters must heat up to about 250° C. (500° F.) before conversion of combustion gases begins. Since the conversion reaction is exothermic, once the reaction starts the temperature will remain high enough to maintain the reaction until the flow of gases through the converter stops. The third advantage of a thin wall for honeycomb catalytic converters is the smaller cell size which is attainable. This smaller cell size increases the surface area-to-volume ratio, with consequent decrease in the size and cost of the converter.

Numerous prior art disclosures relate to metal catalytic converter substrates and to making ferrous base alloys for use in high temperature environments.

Published Japanese Patent Application No. 49-99982 discloses a catalyst support comprising a ferrous metal substrate, a porous iron-aluminum layer, and a porous aluminum oxide layer on which catalyst is deposited. The method comprises forming an aluminum layer on a foil by cladding, spraying, or hop dip coating, and heat treating at 700° C. to 1300° C. (1300° F. to 2400° F.) for 0.5 to 5 minutes to form a porous iron-aluminum layer. Preferably the heat treatment is conducted in an oxidizing atmosphere in order to convert the surface aluminum on the porous layer to aluminum oxide. The ferrous substrate can contain elements such as nickel, chromium and molybdenum. The heat treatment causes the aluminum in the coating and the metals in the substrate to "diffuse mutually." In a specific example an austenitic 18-8 stainless steel foil of 0.1 mm (0.004 in.) thickness was roughened and coated with molten aluminum with a coating thickness of 0.03 mm (0.0011 in.).

U.S. Pat. No. 3,059,326 discloses a method for making ferrous based alloys having substantial oxidation resistance and fortified for use in high temperature environments. The method involves the diffusion of an aluminum or aluminum alloy coating into a base metal containing from 3.5% to 8% aluminum by heating at 1300° F. to 1600° F. for one to three hours. The diffusion raises the aluminum content of the base metal to a total of about 16%. The alleged novelty resides in being able to carry out the desired working or cold reduction before coating since only slight working is possible after coating, according to the patentee. Coating thickness of 0.001 to 0.01 in. (0.025 to 0.25 mm) is disclosed.

U.S. Pat. No. 3,305,323 discloses the production of steel foil of 0.002 in. (0.05 mm) thickness or less, plated with tin, zinc, aluminum, alloys thereof and other metals. It is stated that already coated strip must be free of an intermediate iron-coating metal alloy layer in order to reduce the coated strip to foil thickness in proportion to the base metal during cold rolling. Ordinarily a reduction of 40% to 60% per pass is preferred. Diffusion of chromium and/or nickel coatings by heat treatment is suggested.

U.S. Pat. No. 4,079,157 discloses hot dip coating of an austenitic stainless steel with an aluminum-silicon alloy for automotive thermal reactors. It is stated that the use of pure aluminum coating results in a three-layer structure consisting of base material, which is essentially the unchanged austenitic stainless steel, an outermost layer which consists mainly of a ferritic iron-aluminum alloy, and a ferritic intermediate layer, which lies between the Fe-Al alloy layer and the base material. The different coefficients of thermal expansion of the ferrite and austenite layers cause stresses during cyclic heating with resulting plastic deformation of ferrite layers. The addition of silicon to the coating metal solved this problem since silicon (at 5% to 11%) forms an initial diffusion layer which inhibits subsequent formation of an aluminum diffusion layer. This in turn maintains the thickness of the ferrite layers within required limits, thereby avoiding plastic deformation.

U.S. Pat. No. 4,331,631 discloses a method of producing on the surface of a peeled foil of aluminum bearing ferritic stainless steel densely spaced aluminum oxide whiskers. The method consists of first forming a severely cold worked foil with an irregular surface by a metal peeling process. The foil contains 15% to 25% chromium, 3% to 6% aluminum, 0.3% to 1.0% yttrium (optional), and balance iron. The aluminum oxide wiskers are grown on the foil by heating the peeled foil in air at about 870° C. to 970° C. for a time sufficient to grow the oxide whiskers. The whiskers are stated to be about three microns high. The roughness of the whiskered surface substantially improves adhesion of an aluminum oxide washcoat and overcomes spalling problems encountered with oxide layers having typical smooth or nodular surfaces.

U.S. Pat. No. 4,318,828 discloses a method for forming aluminum oxide whiskers on the surface of an aluminum-containing ferritic stainless steel rolled foil. The method consists of a two part heat treatment. First, the foil is oxidized by heating in an atmosphere comprising predominantly an inert gas and containing 0.1 volume percent or less oxygen between about 875° C. and 925° C. (1606° F. and 1700° F.), said oxidation forming a surface-dulling film capable of producing dense whisker growth. Second, the foil is further oxidized by heating in air between about 870° C. and 930° C. (1600° F. and 1780° F.) for a time sufficient to grow densely spaced whiskers that substantially cover the surface. The method can be used to prepare a cold-rolled metal alloy foil containing 15% to 25% chromium, 3% to 6% aluminum, optionally 0.3 to 1.0 weight percent yttrium and the balance iron. The whiskers improve the adhesion of the aluminum oxide washcoat to the cold-rolled foil and thereby reduce spalling during converter use.

U.S. Pat. No. 4,188,309 discloses a shaped catalyst consisting essentially of a structural reinforcing agent of ferrous metal, a layer of a heat-resistant carrier material on the structural reinforcement agent, and a catalytically active component on the carrier material. The body of the structural reinforcing agent consists of cast or wrought iron, or carbon or low alloy steel and has a surface provided with a non-scaling, adhesive and anchoring-favoring aluminum/iron diffusion layer, this diffusion layer having been obtained by heating an aluminum-coated iron or steel at a temperature between 600° C. and 1200° C. (1100° F. and 2200° F.) for at least one minute.

U.S. Pat. No. 3,867,313 discloses an all metal, high temperature resistant catalyst element that consists of a base material comprised of primarily aluminum, chromium and iron on which is plated or deposited a noble metal comprising platinum and/or palladium. No aluminum oxide washcoat is used. The nickel-free, aluminum containing base material appears to be of advantage for at least certain all metal catalyst element operations and also results in substantially lower cost catalyst units.

Other patents of which applicant is aware, which show the general background of the art, include: U.S. Pat. Nos. 3,362,783; 4,096,095; 4,162,993; 4,277,374; 4,190,559; 3,873,472; 4,247,422; 3,920,583; 4,350,617; 3,907,708; 4,414,023.

Although the prior art is replete with disclosures relating to alloys and methods for making catalyst supports for catalytic converters, there is nevertheless a genuine need for a relatively low cost metal foil which combines high temperature oxidation resistance, wet corrosion resistance and surfaces that will bond securely to a porous aluminum oxide coating, and which can be readily formed from strip thickness material with conventional rolling mill equipment.

SUMMARY OF THE INVENTION

It is an object of the present invention to provide a coated ferrous base metal foil exhibiting the above-described combination of properties.

It is a further object to provide a method of making a coated ferrous base metal foil by hot dip coating a ferritic steel base strip with aluminum and reducing the coated strip to foil thickness economically.

It is still another object of the invention to provide a method of making a coated foil, adapted for fabrication into monolithic structures in catalytic converters, having a porous surface adapted to bond with an activated gamma aluminum oxide washcoat which is impregnated with a catalyst.

According to the invention, there is provided an aluminum coated ferrous base metal foil having a thickness not greater than 0.13 mm formed by cold reduction of a hot dip aluminum coated ferritic base metal strip containing from 10% to about 35% by weight chromium, up to 3% aluminum, up to 1% silicon, and balance essentially iron, the ferritic base metal strip having a thickness of at least 0.25 mm and an aluminum coating thickness ranging from 0.013 to 0.13 mm on each side, the coated foil having a ratio of total aluminum coating thickness (i.e. on both sides) to base metal foil thickness of at least 1:10, with at least 4% by weight total aluminum in the coated foil, the coated foil exhibiting improved high temperature oxidation resistance and improved wet corrosion resistance. When the coated foil is subjected to heat treatment in an oxidizing atmosphere within specified time and temperature ranges, a porous aluminum oxide layer ranging in thickness from about 500 to about 10,000 angstroms is formed on each side, this layer being adapted to bond securely to the washcoat of a heat resistant catalyst support material of a type disclosed in the above-mentioned U.S. Pat. No. 4,188,309.

The invention further provides a method of making an aluminum coated ferrous base metal foil having improved oxidation resistance at elevated temperatures, improved wet corrosion resistance and surfaces adapted to bond securely to a heat resistant catalyst support material, comprising the steps of hot dip coating a ferritic metal strip in a bath of molten aluminum, the strip having a thickness of at least 0.25 mm and containing from 10% to about 35% chromium, up to 3% aluminum, up to 1% silicon and balance essentially iron; finishing the molten aluminum coating to provide a coating thickness ranging from 0.013 to 0.13 mm on each side and a total aluminum content of at least 4% by weight; cold reducing the aluminum coated strip to a foil having a thickness not greater than 0.13 mm without intermediate annealing, wherein the ratio of total aluminum coating thickness (i.e. on both sides) to base metal thickness is at least 1:10; and heating the foil in an oxidizing atmosphere within the range of about 600° to about 1200° C. with a time at temperature ranging from about 1 second to about 1 hour in accordance with the relationship:

$1210 > \text{temperature (°C.)} + 1/6 \times \text{time (seconds)} > 600$, whereby to produce a porous surface having a matte gray appearance.

The step of heating the foil in an oxidizing atmosphere causes diffusion of a portion of the aluminum coating into the ferritic base metal and formation of a porous aluminum oxide layer on the surfaces of the foil having a thickness of about 500 to about 10,000 angstroms.

The method of the invention further includes the additional steps of applying a washcoat of heat resistant catalyst support material, such as activated gamma aluminum oxide, to the porous surface on each side of the heat treated foil, and impregnating the coating with a catalyst.

BRIEF DESCRIPTION OF THE DRAWING

Reference is made to the accompanying drawing wherein:

FIGS. 1A through 1D are photomicrographs of vertical sections of aluminum coated steel heat treated for different periods of time at a temperature within the preferred range of the method of the invention;

DETAILED DESCRIPTION

Figure 2:
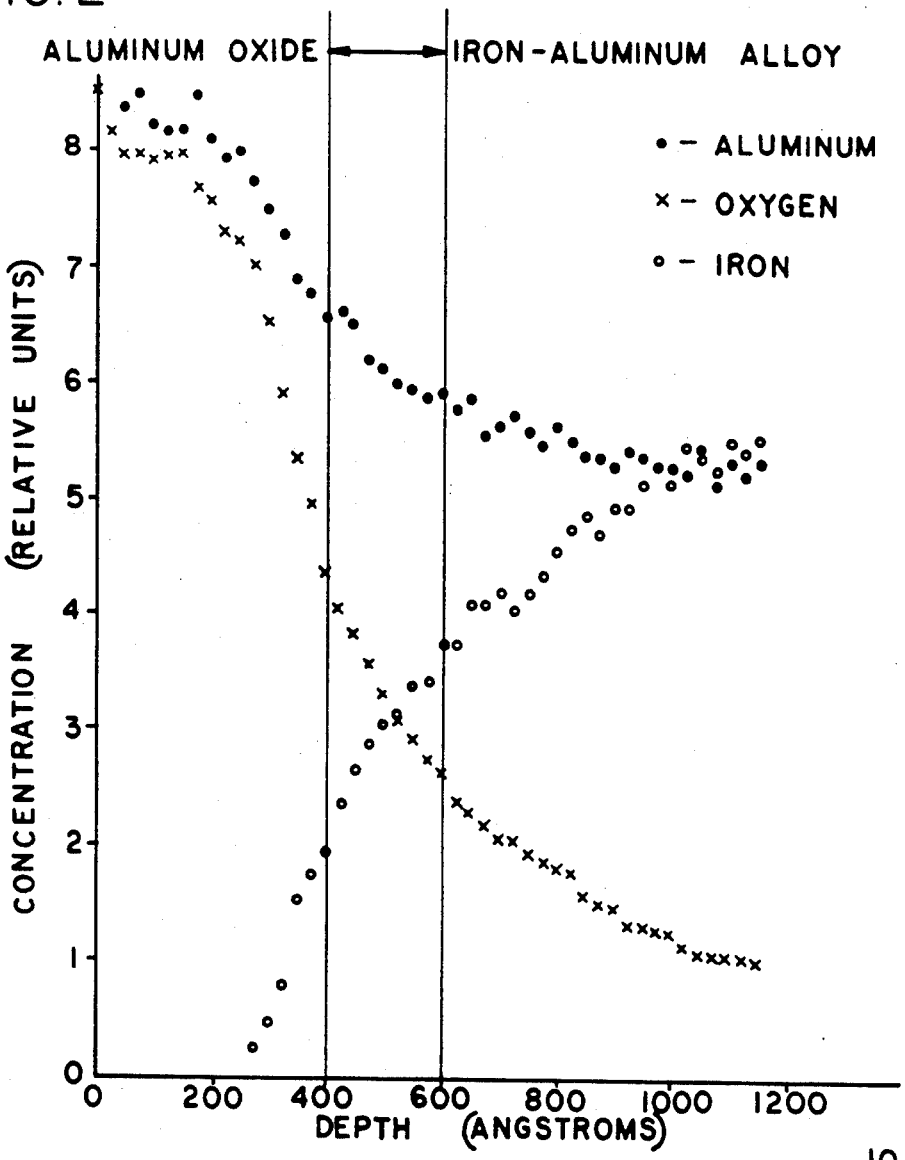
FIG. 2 is a graphic representation of a depth profile of a heat treated aluminum coated foil in accordance with the invention, showing the concentration of aluminum, iron and oxygen atoms.

The present invention utilizes the concept of hot dip coating a ferrous base metal strip in coil form with molten aluminum. It will be understood that the aluminum coating metal will contain about 2% by weight iron due to dissolution of iron from the surface of the strip as it passes through the molten aluminum coating bath.

The invention provides a relatively low cost starting material and relatively low processing costs, due primarily to the following considerations:

The ferrous strip starting material contains a relatively low level of alloying elements present in sufficient amounts to ensure the necessary high temperature oxidation resistance and wet corrosion resistance of the final foil. The type and amount of each alloying element is restricted in order to ensure ready wetting of the strip surfaces by molten aluminum and to ensure cold rollability to foil thickness by conventional rolling mill equipment, without special steps such as warm rolling or intermediate annealing.

The method of the invention involves a relatively short one-step heat treatment of the coated, cold rolled foil in an oxidizing atmosphere to produce a porous surface covered with a thin layer of aluminum oxide which exhibits good adherence to a washcoat, thereby satisfying the three essential properties described above.

The starting material is cold rolled strip of a ferritic chromium-iron alloy containing from 10% to about 35% by weight chromium. A minimum of 10% chromium must be observed for adequate corrosion resistance in atmospheres containing water vapor and combustion gases. The chromium addition also provides oxidation resistance at elevated temperature, and the maximum chromium level may be selected for adequate oxidation resistance at a required operating temperature in accordance with a relationship set forth hereinafter. A maximum of 35% chromium is dictated by cost and processing difficulty. Preferably chromium can be maintained at a maximum of about 25% for any operating temperature which might be encountered.

Up to 3% by weight aluminum may be present in the ferrous base metal strip starting material. Aluminum in excess of 3% would cause the ductile-to-brittle transition temperature of ferritic strip to be higher than normal cold processing temperatures. Hence a high ductile-to-brittle transition temperature would require special processing such as a hot slab handling practice in which the metal in slab form cannot be allowed to cool and involving warm rolling, instead of conventional cold rolling when reducing to strip thickness. Moreover, increasing aluminum content increases the difficulty in wetting the strip with molten aluminum in a hot dip coating process. A 10% chromium ferrous alloy containing more than 3% aluminum cannot be coated on conventional hot dip coating lines. Aluminum improves high temperature oxidation resistance, and an addition within the range of about 0.5% to about 1.0% may be used.

Silicon may be present up to 1%, and silicon in excess of this amount causes the same problems as excessive aluminum, namely difficulty in wetting the strip with molten aluminum and difficulty in rolling. Silicon also improves elevated temperature oxidation resistance, and as little as about 0.1% is effective for this purpose. A silicon range of about 0.1% to 1.0% is thus preferred.

A relationship has been discovered between the operating temperature of the catalyst support structure and the chromium, silicon and aluminum levels required in the ferrous base metal strip for adequate oxidation resistance. For chromium contents ranging between about 10% and 35%, silicon contents up to about 1% and aluminum contents up to about 3%, this relationship is expressed by the formula $$\text{Operating temperature (°C)} = 15\,[\%\,Cr + 1.5 \times \%\,Si + 3 \times \%\,Al] + 800°\,C. \quad (1)$$

The operating temperature is that which the catalyst support will experience during normal operation. The support structure must also withstand temperature excursions about 100° C. above the normal operating temperature for about 10% of the life of the catalytic converter. An automotive catalytic converter is expected to operate for about 1000 to 3000 hours.

A conservative estimate of operating temperature for a typical automotive catalytic converter is about 800° to 900° C. (1500° to 1650° F.). Since at least 10% chromium is needed for wet corrosion resistance, this is the minimum value for chromium which would be used in formula (1), and it is thus apparent that no additional silicon or aluminum would be required to meet an 800° C. operating temperature, in accordance with this formula.

In view of this, Type 409 ferritic stainless steel is particularly preferred as the starting material for the present invention. This has a nominal composition of about 11% chromium, about 0.5% silicon and remainder essentially iron. More broadly, a ferritic steel containing from about 10.0% to about 14.5% chromium, about 0.1% to 1.0% silicon, and remainder essentially iron, is preferred. After coating with aluminum, Type 409 stainless steel is ideally suited as an economical catalyst substrate for typical automotive catalytic converters. For applications requiring greater or less corrosion resistance and greater or less elevated temperature oxidation resistance, a different composition could be selected on the basis of formula (1) above. In general, the chromium level would be predetermined by the degree of corrosion resistance needed, while the aluminum and silicon levels would be determined from formula (1) on the basis of the operating temperature and chromium level.

The present invention includes limitations on the thickness of the aluminum coating applied to the strip as well as the thickness of the strip being coated. The aluminum coating thickness range is from 0.013 to 0.13 mm (0.0005 to 0.005 in.) on each side. The ratio of the total aluminum coating thickness on both sides to the base metal thickness is at least 1:10 and may range up to about 1:4.

The upper limitation on aluminum thickness is dictated by the maximum coating thickness which can be applied to a strip by the continuous hot dip coating method. The lower limitation on aluminum thickness is fixed by the need to maintain at least a 1:10 ratio of coating to base metal thickness, and the fact that it is not feasible to coat a strip with aluminum economically if the strip thickness is below 0.25 mm. Material having a lesser thickness is too fragile to pass through a coating line without tearing, and the much greater surface area to be coated would entail long coating runs on expensive coating lines.

Further significant factors have been found to require the above limitations on coating thickness and coating to base metal ratio. Applicant has discovered that a minimum amount of aluminum is needed at or near the surface of the catalyst support in order to maintain the necessary high temperature thermal oxidation resistance. At temperatures above about 500° C. aluminum from the coating and iron from the base metal begin to intermix, and an aluminum-iron alloy forms in a layer along the surface. The amount of aluminum present near the surface of the catalyst support after it has been exposed to high temperature is dependent on the thickness of the base steel, the thickness of the aluminum coating, the temperature to which the support is subjected, and the time at temperature. The diffusion of the aluminum coating with the base steel increases with increasing time and/or temperature. It will be evident that the minimum aluminum concentration near the surface of the catalytic support will occur when aluminum has diffused to a uniform concentration throughout the thickness of the support. In order to withstand operating temperatures up to about 1100° C., there should be at least 4% by weight aluminum at the surface. If substantially no aluminum is in the base steel, this means that at least 4% by weight aluminum must be coated onto the strip. A maximum of about 30% by weight aluminum should be observed. The thinnest strip which can be coated feasibly in the practice of the present invention, namely 0.25 mm, thus requires an aluminum coating thickness of at least 0.013 mm on each side in order to achieve the 4% minimum after maximum heat exposure. On the other hand, if the base steel strip contains aluminum, then the minimum aluminum contribution from the coating decreases arithmetically in such manner that there is at least 4% by weight total aluminum in the coated strip.

Another significant feature arises from the fact that automotive catalyst supports require a high surface area-to-volume ratio. This is effected by coating the catalyst support with a heat resistance catalyst support material such as activated gamma aluminum oxide, which increases the surface area by a factor between 1000 and 10,000. The precious metal catalyst is then deposited on this coating. Without this great increase in surface area pollution control catalytic converters could not meet present standards for reduction of carbon monoxide, hydrocarbons and nitrogen oxides. In order to remain effective, the large surface area aluminum oxide or other catalyst support material must adhere strongly to the support. Lack of adherence of a washcoat to most metallic support structures results from the large stresses created at the metal-washcoat interface during thermal cycling of the converter in normal operation. These stresses arise from the great difference in thermal expansion coefficients of the ceramic aluminum oxide coating and the metallic support structure. It is an important feature of the present invention that a simple, low cost heat treating step of the coated foil produces an ideal surface for promoting adherence of the washcoat.

The method of the present invention includes as an essential step a heat treatment governed by a time-temperature relationship which achieves a surface adapted to bond securely to a washcoat. More specifically, the single heat treating step comprises heating the coated foil in an oxidizing atmosphere, for instance, air, for a time ranging from about 1 second to about 1 hour at a temperature between about 600° and about 1200° C. (1110° and 2050° F.). The temperature and time at temperature are in accordance with the following relationship:

$$1210 > \text{temperature (°C.)} + 1/6 \times \text{time (seconds)} > 600 \quad (2)$$

While the broad temperature-time relation set forth above can be relied upon to produce a porous surface having a matte gray appearance, when heat treating an aluminum-coated foil wherein the base metal is within the preferred composition ranges set forth above, best results are obtained by heating at about 700° to about 1000° C. (about 1290° to about 1830° F.) with a time at temperature of about 1 to about 20 seconds in accordance with the following preferred relationship:

$$1100 > \text{temperature (°C.)} + 15 \times \text{time (seconds)} > 1000 \quad (3)$$

The heat treatment step of the method of the invention improves adherence of a ceramic washcoat by causing two changes at the surfaces of the aluminum coated foil. The heat treatment first causes the aluminum coating and the base steel to alloy, starting at the aluminum coating-base steel interface and growing toward the free surface. The alloying causes voids to form along the aluminum-alloy interface. These voids are due to the vacancy mechanism of diffusion and the significantly different diffusion rates for iron into aluminum and aluminum into iron. By the time that alloy growth advances near the free surface, the layer of voids preceding it is almost continuous. This layer of voids finally reaches the surface of the sheet, causing the sheet to take on a matte gray appearance, which contrasts sharply with the shiny surface of the foil prior to heat treatment. The dull appearance is an indication of the large increase in surface area and roughness caused by the band of voids intersecting the free surface. The gray appearance is not a result of aluminum oxide formation.

Table I summarizes a comparison of the surface roughness of an aluminum-coated foil before and after heat treatment. It will be evident that the heat treatment increased the average peak height by a factor of 6 and increased the peak density by a factor of at least 70.

TABLE I

| Aluminum-coated Steel Foil | Surface roughness Average Peak Height (microns) | Peak Density (peaks/cm) |
|---|---|---|
| Before heat treatment* | 0.07 | <1 |
| After heat treatment* | 0.43 | 70 |

*Heat treatment @ 980° C. (1800° F.) for > 1 second

Reference is next made to FIGS. 1A through 1D, wherein void formation, void migration and porous surface roughness increase are shown with progressively increasing times at a temperature of 700° C. (about 1290° F.). Each of these figures is a photomicrograph of a vertical section of aluminum coated foil at 500× magnification.

Once the desired porous surface has been formed by the above described diffusion process, prolonged heat treatment causes the surface area to decrease, for reasons which are not fully understood at present. Accordingly, maximum surface porosity is obtained only by observing the broad and preferred relationships (2) and (3) set forth above.

The above described heat treatment in an oxidizing atmosphere also causes formation of a thin aluminum oxide layer which covers the entire porous surface. Reference is made to FIG. 2 which is a graphic representation of the depth profile of an aluminum coated foil heat treated in accordance with relationship (3). The aluminum oxide layer in FIG. 2 is about 500 angstroms in thickness. The preferred range of thickness of this aluminum oxide layer has been found to be from about 500 to about 10,000 angstroms.

Figure 3:
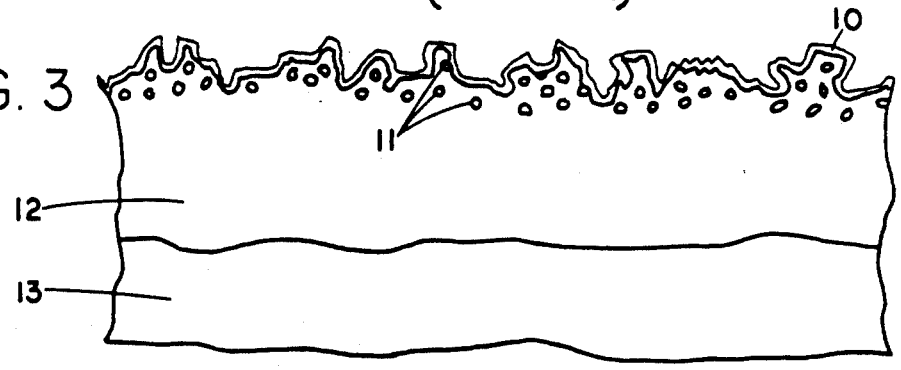
FIG. 3 is a schematic drawing of layers present at the surface of a foil embodying the invention, before application of a washcoat of a heat resistant catalyst support material.

The porous surface and aluminum oxide layer combine to promote good adherence of an aluminum oxide washcoat. The pores provide mechanical interlocking between the substrate and washcoat, and the irregular interface and porous surface prevent large stresses from developing. Moreover, the aluminum oxide surface layer matches well chemically and thermally with the aluminum oxide washcoat. Reference is made to FIG. 3 which is a schematic illustration of a vertical section through a portion of a heat treated aluminum coated foil of the invention, before application of a washcoat. A continuous aluminum oxide surface layer is indicated at 10, a rough porous surface of an aluminum-iron alloy is indicated at 11, a non-porous aluminum-iron alloy layer at 12, and a base metal layer at 13 which is substantially unalloyed with aluminum from the coating.

When a washcoat is applied and impregnated with a precious metal catalyst, the completed support structure will have a base metal layer which is not alloyed to a substantial extent with aluminum from the coating. However, when placed in operation further diffusion of aluminum into the base metal and diffusion of iron into the coating will occur gradually over a period of time. It is an advantage of the present invention that observance of the minimum of at least 4% by weight aluminum and observance of the coating to base metal ratio will still provide adequate protection against high temperature oxidation over all areas of the support structure, including the edges, even after diffusion of aluminum has occurred uniformly throughout the thickness of the structure. The porous surface and good adherence remain intact.

In an exemplary routing embodying the invention, Type 409 stainless steel strip having a thickness ranging between about 0.4 and about 1.0 mm is subjected to conventional pretreatment for removal of surface contaminants such as oil, grease, oxide film and the like and brought approximately to the temperature of a Type 2 aluminum coating metal bath. The coating metal is substantially pure aluminum containing about 2% iron and is maintained at a temperature of about 670° to about 705° C. Aluminum alloys containing silicon are not satisfactory in the practice of the present process. The strip is then passed through the coating metal bath and conducted upwardly therefrom. The coated strip is finished by passing between oppositely disposed gas (usually air) knives to provide a coating thickness ranging from about 0.04 to about 0.10 mm on each side. After solidification of the coating metal the strip is cold reduced in a conventional cold rolling mill to a coated foil having a thickness of about 0.04 to about 0.10 mm. Typically this would involve about 6 to 8 passes on a cold rolling mill, without intermediate annealing.

Cold reduction of this order of magnitude causes reduction of both the aluminum coating and the steel strip in the same ratio. Thus, if the ratio of aluminum coating thickness on both sides to the base strip thickness is 1:10, the ratio of coated foil coating thickness on both sides to base metal foil thickness will also be 1:10, and there will then be at least 4% by weight total aluminum in the coated foil.

The foil is then subjected to a continuous anneal in air at a temperature of about 700° to about 1000° C. with a time at temperature ranging from about 1 to about 20 seconds, with the time inversely proportional to the temperature (preferably in accordance with relationship (3) above), thereby producing a porous surface having a matte gray appearance. A washcoat of activated gamma aluminum oxide is next applied to both sides of the foil and dried. Finally, the washcoat is impregnated with a catalyst by application of a solution of salts of at least one of platinum, rhodium and palladium, followed by drying and calcination in conventional manner.

The product obtained by the above procedure is adapted for fabrication into monolithic honeycomb catalyst supports without cracking of the foil or peeling of the coating.

The use of a ferritic steel rather than an austenitic stainless steel is advantageous both from the standpoints of ease of processing and differences in coefficients of thermal expansion.

More specifically, ferritic steels can be cold reduced with a larger percentage of reduction than austenitic steels for a given rolling mill force and a given number of passes through the rolling mill. Austenitic steels cold work harden more quickly and hence the percent of reduction in thickness which can be made on a pass through the rolling mill is substantially less. Cold work hardening factors for five common stainless steels are set forth in Table II along with chemical compositions thereof. It will be apparent from Table II that the two austenitic steels have work hardening factors at least 60% greater than that of the three ferritic steels. Eventually, the percent reduction for each pass becomes so small for an austenitic steel that it must be subjected to an intermediate anneal. However, the annealing of an aluminum-coated austenitic steel causes the aluminum to diffuse into the base metal, forming a brittle high-aluminum phases on both sides of the austenitic core. These brittle layers resist further cold reduction. As pointed out above, the present invention provides cold reduction of aluminum coated ferritic strip to foil thickness without an intermediate anneal.

Moreover, when using an austenitic stainless steel as a base metal, diffusion of an aluminum coating into the austenitic substrate causes a phase change in the alloyed layer from austenite to ferrite. This results in a composite of an austenitic core covered by two ferritic layers, the thicknesses of which depend upon the temperature of heat treatment and the aluminum diffusion profile. Because of the differences in coefficients of thermal expansion of austenite and ferrite, the composite does not maintain its shape when thermally cycled, particularly if the composite is in the form of a foil. Relatively large thermal distortions thus occur which are unacceptable for metallic catalyst support structures.

TABLE II

| Composition[2] (wt. %) | | | | |
|---|---|---|---|---|
| Cr | Ni | C | Structure | Cold Work Hardening Factor[1] |
| 18 | 10 | .06 | Austenite | 105 |
| 18 | 8 | .06 | Austenite | 127 |
| 18 | .3 | .06 | Ferrite | 60 |
| 12 | .1 | .06 | Ferrite | 58 |
| 10 | .1 | .06 | Ferrite | 55 |

[1]Bloom, F. K., Goller, G. N. and Mabus, P. G., "The cold-Work Hardening Properties of Stainless Steel in Compression," present at American Society of Metals National Metals Congress Atlantic City, New Jersey, Week of November 18, 1946.
[2]Balance primarily iron.

We claim:

1. A method of making an aluminum coated ferrous base metal foil having improved oxidation resistance at elevated temperatures, improved wet corrosion resistance, and surfaces adapted to bond securely to a ceramic, heat resistant catalyst support material, comprising the steps of:

hot dip coating a ferritic base metal strip in a bath of molten aluminum, said strip having a thickness of at least 0.25 mm and containing from 10% to about 35% chromium, up to 3% aluminum, up to 1% silicon, and balance essentially iron;

finishing the molten aluminum coating to provide a coating thickness ranging from 0.013 to 0.13 mm on each side and a total aluminum content of at least 4% by weight;

cold reducing the aluminum coated strip to a foil having a thickness not greater than 0.13 mm without intermediate annealing wherein the ratio of total aluminum coating thickness to base metal thickness is at least 1:10; and heating said foil in an oxidizing atmosphere within the range of about 600° to about 1200° C. with a time at temperature ranging from about 1 second to about 1 hour in accordance with the relationship:

$1210 > \text{temperature (°C.)} + 1/6 \times \text{time (seconds)} > 600$, whereby to produce a porous surface having a matte gray appearance.

2. The method claimed in claim 1, wherein the step of heating said foil in an oxidizing atmosphere is conducted within the range of about 700° to about 1000° C. with a time at temperature ranging from about 1 second to about 20 seconds in accordance with the relationship:

$1100 > \text{temperature (°C.)} + 15 \times \text{time (seconds)} > 1000$.

3. The method claimed in claim 1 or 2, wherein the step of heating said foil in an oxidizing atmosphere causes diffusion of a portion of the aluminum coating into the ferritic base metal and formation of an aluminum oxide layer on the surfaces of said foil having a thickness of about 500 to about 10,000 angstroms.

4. The method claimed in claim 1 or 2, wherein said ferritic base metal strip contains from about 11.0% to about 14.5% chromium and about 0.5% to 1.0% silicon.

5. The method claimed in claim 1 or 2, wherein said ferritic base metal strip has a thickness of about 0.4 to about 1.0 mm, the aluminum coating has a thickness of about 0.04 to about 0.10 mm before cold reduction, and said strip is cold reduced to a foil thickness of about 0.04 to about 0.10 mm.

6. The method of claim 4, wherein the composition of said ferritic base metal strip is based on the intended operating temperature of said foil in accordance with the formula:

$\text{Operating temperature (°C.)} = 15\ [\%\ Cr + 1.5 \times \%\ Si + 3 \times \%\ Al] + 800°\ C.$

* * * * *